US010803838B2

(12) United States Patent
Ishizaka

(10) Patent No.: US 10,803,838 B2
(45) Date of Patent: Oct. 13, 2020

(54) BODY OF ELECTRIC GUITAR AND ELECTRIC GUITAR

(71) Applicant: Yamaha Corporation, Hamamatsu-shi, Shizuoka (JP)

(72) Inventor: Kenta Ishizaka, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 16/567,173

(22) Filed: Sep. 11, 2019

(65) Prior Publication Data

US 2020/0005740 A1 Jan. 2, 2020

Related U.S. Application Data

(63) Continuation of application No. PCT/JP2018/009222, filed on Mar. 9, 2018.

(30) Foreign Application Priority Data

Mar. 15, 2017 (JP) ..... 2017-050528

(51) Int. Cl.
*G10D 1/08* (2006.01)
*G10H 3/18* (2006.01)

(52) U.S. Cl.
CPC ..... *G10D 1/085* (2013.01); *G10H 3/181* (2013.01)

(58) Field of Classification Search
CPC ..... G10D 1/085
See application file for complete search history.

(56) References Cited

U.S. PATENT DOCUMENTS 4,313,362 A * 2/1982 Lieber ..... G10D 3/22 84/267
4,334,452 A * 6/1982 Morrison, III ..... G10D 1/085 84/267
4,359,923 A * 11/1982 Brunet ..... G10D 3/02 84/267
4,696,219 A * 9/1987 Plescia ..... G10D 3/12 84/299
4,829,870 A * 5/1989 Ralston ..... G10D 1/085 84/291
4,919,029 A * 4/1990 Excellente ..... G10D 3/02 84/291
5,052,269 A * 10/1991 Young, Jr. ..... G10D 1/085 84/291
5,131,307 A * 7/1992 Castillo ..... G10D 1/085 84/267
5,682,003 A * 10/1997 Jarowsky ..... G10D 1/085 84/267
5,767,432 A 6/1998 Randolph
(Continued)

OTHER PUBLICATIONS

International Search Report (PCT/ISA/210) issued in PCT Application No. PCT/JP2018/009222 dated May 29, 2018 with English translation (five (5) pages).

*Primary Examiner* — Robert W Horn
(74) *Attorney, Agent, or Firm* — Crowell & Moring LLP

(57) ABSTRACT

A body of an electric guitar includes: a main body that includes a solid body and includes a recess; and a recess rigidity reinforcing member that is in contact with two or more contact regions of an inner surface of the recess and reinforces the rigidity of the recess, the two or more contact regions being located away from each other.

7 Claims, 5 Drawing Sheets

(56) References Cited

U.S. PATENT DOCUMENTS

| | | | | |
|---|---|---|---|---|
| 6,233,825 | B1 * | 5/2001 | DeGroot | G10D 1/085 29/896.22 |
| 6,255,567 | B1 * | 7/2001 | Minakuchi | G10D 1/085 84/291 |
| 6,294,718 | B1 * | 9/2001 | Saunders, Jr. | G10D 3/02 84/291 |
| 6,359,208 | B1 * | 3/2002 | Farnell, Jr. | G10D 1/085 84/726 |
| 6,664,453 | B2 * | 12/2003 | Ito | G10D 1/085 84/293 |
| 6,911,590 | B2 * | 6/2005 | Childress | G10D 1/00 84/291 |
| 6,998,524 | B2 * | 2/2006 | Teuffel | G10D 1/085 84/291 |
| 7,507,885 | B2 * | 3/2009 | Coke | G10D 1/085 84/267 |
| 7,598,444 | B2 * | 10/2009 | Farnell, Jr. | G10D 3/22 84/291 |
| 10,692,475 | B2 * | 6/2020 | Ishizaka | G10D 1/085 |
| 2003/0041719 | A1 * | 3/2003 | Fisher, IV | G10D 3/12 84/314 N |
| 2008/0202309 | A1 * | 8/2008 | Wiswell | G10D 1/085 84/291 |
| 2020/0005740 | A1 * | 1/2020 | Ishizaka | G10D 1/08 |

* cited by examiner

BODY OF ELECTRIC GUITAR AND ELECTRIC GUITAR

CROSS-REFERENCE TO RELATED APPLICATION

Priority is claimed on Japanese Patent Application No. 2017-050528, filed Mar. 15, 2017, the contents of which are incorporated herein by reference.

BACKGROUND OF THE INVENTION

Field of the Invention

The present invention relates to a body of an electric guitar capable of improving string vibration characteristics, and to an electric guitar including the same body.

Description of Related Art

In an electric guitar, an electromagnetic pickup converts vibration of a string into an electric signal by means of electromagnetic induction. The converted electric signal is amplified by an amplifier and output as sound from a speaker.

The vibration of the string of the electric guitar is also transmitted to a body and a neck of the electric guitar. In order to vibrate the body and the neck, vibration energy of the string is consumed and the vibration of the string is attenuated. Thus, the body and the neck affect the vibration of the strings and the sound quality of the electric guitar.

As a body of an electric guitar, a solid body having no hollow cavity thereinside is often used. In a body of an electric guitar that is a solid body there are formed a portion for joining a neck therewith (hereinafter referred to as "neck pocket") and a recess such as an electrical component counterbore for housing an electrical component. Also, in order to make it easy to play an electric guitar, often, cutaway processing is performed to cut and remove a part of the body, and the remaining portion that is not cutaway is formed as a protrusion in the body. Accordingly, many recesses and protrusion parts are formed in the body of an electric guitar.

When the vibration transmitted to the body of the electric guitar is transmitted to the entire body in a well-balanced manner, rich vibration can be generated in the body, and feedback of the vibration can be made to strings or a bridge (a portion in which the strings are attached to the body).

In the body of the electric guitar, a vibration mode, which is a vibrational characteristic of the structure (the shape, the material, and so forth) of the body, is excited. By analyzing the balance of the "mode shape", which indicates a deformed shape of the body when vibrated at a natural frequency corresponding to the vibration mode, it is possible to investigate whether or not well-balanced vibration occurs in the entire body. For example, when a portion where vibration displacement is large is biased to a part of the body, it cannot be said that the balance of vibration is good.

SUMMARY OF THE INVENTION

In a body of an electric guitar, recesses and protrusions as described above create a portion where the rigidity becomes locally low. The portion of the body where rigidity is low is more susceptible to vibration than other portions. For this reason, vibration displacement tends to be large in the portion where rigidity is low. As a result, the balance of the mode shape of the entire body (balance of vibration) deteriorates. In such a case, the vibration of the string attenuates early or the amplitude of the string vibration does not become large immediately after the string is played.

Also, if a bridge or a neck pocket is arranged at a position serving as a node of the standing wave of the natural frequency in the vibration mode, the vibration of the string is not transmitted to the body easily. As a result, it is impossible to generate rich vibration in the body, and to feedback the vibration to the string.

U.S. Pat. No. 4,829,870 (hereinafter Patent Document 1) discloses an electric guitar in which a metal plate is fixed to a body thereof to thus improve sound quality. However, in Patent Document 1, the purpose of providing the metal plate is to influence the vibration generated in the body, and is not to adjust the balance of the mode shape (vibration balance) occurring in the body.

The present invention has been made in view of the above circumstances. An object of the present invention is to provide a body of an electric guitar capable of adjusting the balance of the generated mode shape (vibration balance) to thus improve sound quality, and an electric guitar including the same body.

In order to solve the above problem, the present invention proposes the following means.

A body of an electric guitar according to an aspect of the present invention includes: a main body that includes a solid body and includes a recess; and a recess rigidity reinforcing member that is in contact with two or more contact regions of an inner surface of the recess and reinforces the rigidity of the recess, the two or more contact regions being located away from each other.

A body of an electric guitar according to an aspect of the present invention includes: a main body that includes a solid body and includes a protrusion; and a protrusion rigidity reinforcing member that is attached to the main body, and at least a part of the protrusion rigidity reinforcing member is fixed to a connecting portion between the protrusion and another portion of the main body.

A body of an electric guitar according to an aspect of the present invention includes: a main body that includes a solid body; and a flexural rigidity reinforcing member that includes a first end part and a second end part and is attached to the main body, and the first end part and the second end part are arranged in a direction orthogonal to a stringing direction in which a string of an electric guitar are to be strung.

An electric guitar according to an aspect of the present invention includes any one of the above-mentioned bodies.

DETAILED DESCRIPTION OF THE INVENTION

Hereinafter, a body of an electric guitar and an electric guitar including the same body according to an embodiment of the present invention will be described with reference to FIG. 1 to FIG. 3. In order to make the drawings legible, the proportion of thickness or dimension of each component is adjusted where appropriate.

Figure 1:
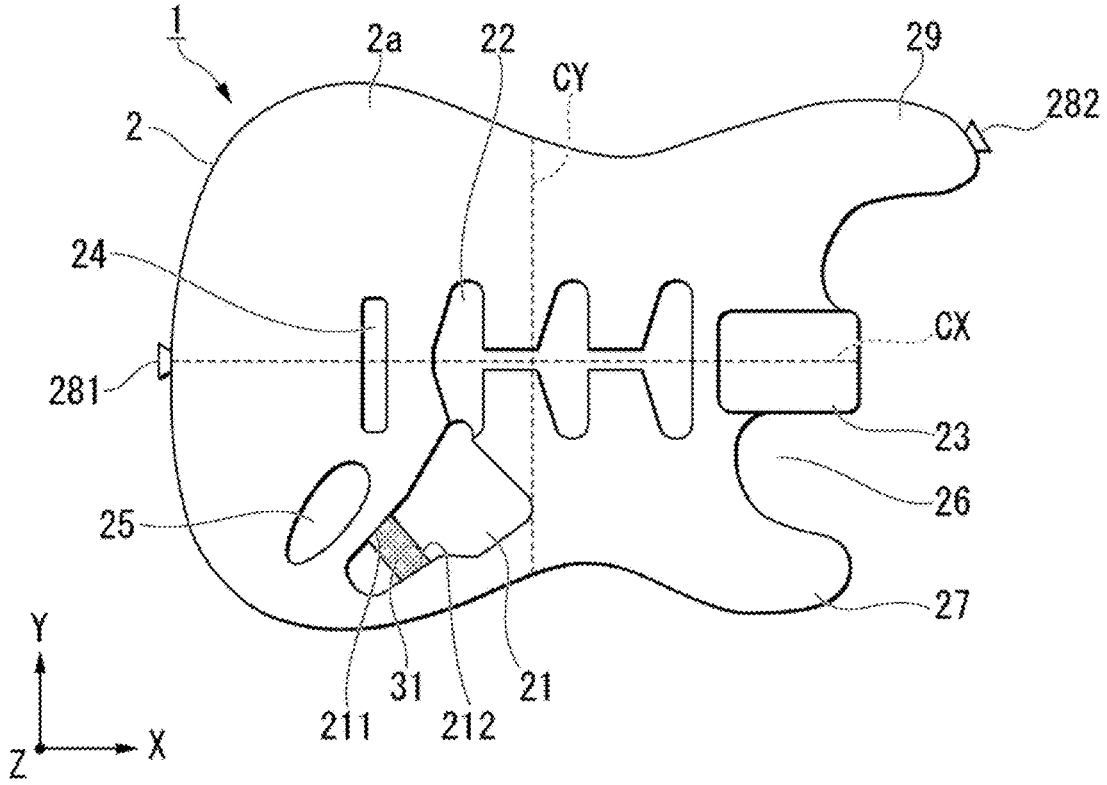
FIG. 1 is a plan view of a body of an electric guitar according to an embodiment of the present invention.

FIG. 1 is a plan view of a body 1 of an electric guitar according to the present embodiment as seen from a front surface 2*a* of the body 1. The front surface 2*a* of the body 1 is one surface of the body 1 orthogonal to a plate thickness direction (a Z axis direction) of the body 1. FIG. 2 is a plan view seen from a back surface 2*b* of the body 1. The back surface 2*b* of the body 1 is the opposite surface to the surface 2*a* of the body 1 and is another surface of the body 1. FIG. 3 is a plan view of an electric guitar 10 including the body 1 as seen from the front surface 2*a* of the body 1.

Figure 2:
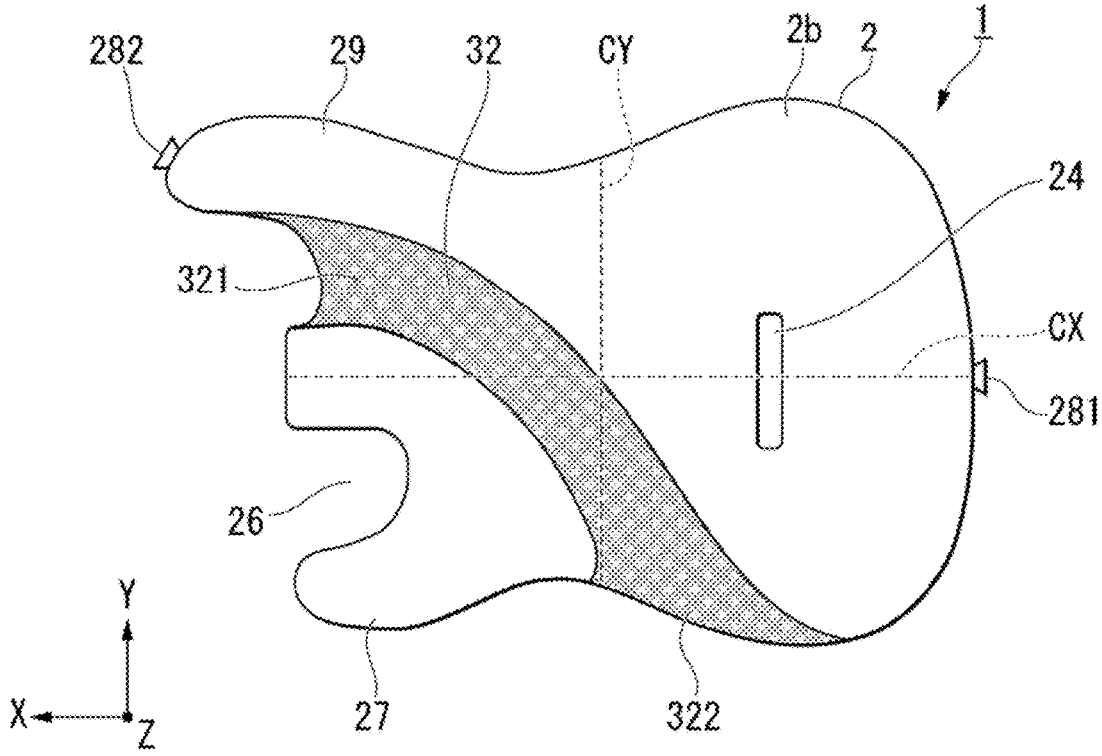
FIG. 2 is a plan view of the body of FIG. 1 viewed from a different direction.

As shown in FIG. 1 and FIG. 2, the body 1 according to the present embodiment includes: a main body 2; an electrical component counterbore rigidity reinforcing member 31 (a recess rigidity reinforcing member, or a reinforcing member); and a protrusion rigidity reinforcing member (a reinforcing member) 32.

Figure 3:
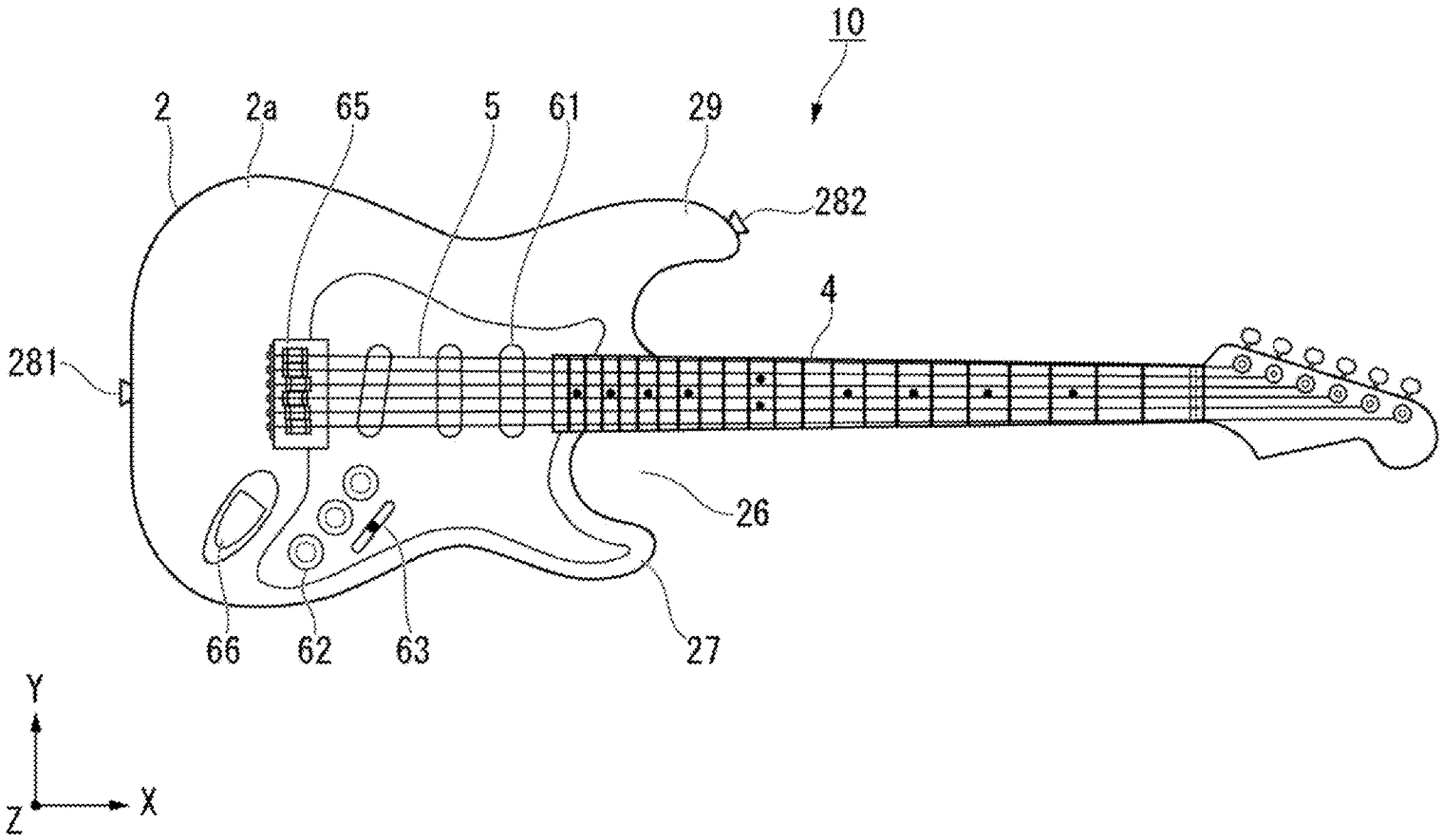
FIG. 3 is a plan view of the body of an electric guitar according to the embodiment of the present invention.

As shown in FIG. 3, an electric guitar 10 includes the body 1, a neck 4, and strings 5. The neck 4 has an elongated shape. A proximal end of the neck 4 is inserted into and joined with a neck counterbore 23 (a neck pocket) of the body 1 described later. The strings 5 are strung along a longitudinal direction (a stringing direction, an X axis direction) of the neck 4.

The main body 2 is made up of a solid body having no hollow cavity thereinside. A material of the main body 2 may be a wood material such as alder, maple, mahogany, or the like. The material of the main body 2 may be a plurality of types of wood in which two or more different woods are combined. The main body 2 is formed in a plate shape.

As shown in FIG. 1 and FIG. 2, in the main body 2 there are formed a plurality of counterbores (recesses, housing parts) including an electrical component counterbore 21, electromagnetic pickup counterbores 22, the neck counterbore 23, a bridge counterbore 24, and a jack counterbore 25. Only the bridge counterbore 24 penetrates through the main body 2 and the other counterbores do not penetrate through the main body 2.

The electrical component counterbore 21 is a counterbore for housing an electrical component. The electrical component is, for example, a controller that adjusts the volume, tone, and so forth of an acoustic signal output from electromagnetic pickups 61 (see FIG. 3) of the electric guitar 10. The electrical component counterbore 21 opens in the plate thickness direction (the Z axis direction) on the surface 2*a* of the main body 2.

As shown in FIG. 3, the controller includes three volume switches 62 and a pickup selector 63 for switching the electromagnetic pickup 61 to be activated.

Each electromagnetic pickup counterbore 22 is a counterbore for housing the electromagnetic pickup 61. The electromagnetic pickup counterbore 22 opens in the plate thickness direction (the Z axis direction) on the surface 2*a* of the main body 2. A plurality of electromagnetic pickups 61 can be housed in the electromagnetic pickup counterbores 22. The electromagnetic pickup 61 is, for example, a single coil pickup or a hum-bucking pickup. The electromagnetic pickup counterbores 22 are arranged aligned in the stringing direction (the X axis direction). In the main body 2 of the present embodiment, the electromagnetic pickup counterbores 22 are formed so that three single coil pickups can be arranged side by side.

The neck counterbore 23 is a counterbore for housing and joining the proximal end of the elongated neck 4 with the main body 2. The neck counterbore 23 opens in the plate thickness direction (the Z axis direction) on the surface 2*a* of the main body 2. The neck counterbore 23 opens also in the stringing direction (the X axis direction) on an end surface of the main body 2.

The neck counterbore 23 is formed at the center portion of the main body 2 in the Y axis direction. The Y axis direction is a direction orthogonal to the plate thickness direction (the Z axis direction) and the stringing direction (the X axis direction). The neck counterbore 23 is arranged aligned with the electromagnetic pickup counterbores 22 in the stringing direction (the X axis direction).

The proximal end of the neck 4 is inserted into the neck counterbore 23. Then, the neck 4 is attached to the main body 2 by being joined to the main body 2 by means of a joint screw or an adhesive.

The bridge counterbore 24 is a counterbore for housing a bridge 65 (see FIG. 3) that fixes the proximal end of each string 5. Also, the bridge counterbore 24 is arranged aligned with the neck counterbore 23 and the electromagnetic pickup counterbores 22 in the stringing direction (the X axis direction).

Pegs are provided on a head at a distal end of the elongated neck 4. The string 5 can be wound around each peg of the head.

The jack counterbore 25 is a counterbore for housing a jack 66 (see FIG. 3). The jack counterbore 25 opens in the plate thickness direction (the Z axis direction) on the surface 2*a* of the main body 2.

A cable is inserted into the jack 66. An acoustic signal that is output from the electromagnetic pickup 61 is output to the cable via the jack 66.

As described above, the plurality of counterbores formed in the main body 2 are recesses formed in the main body 2 in order to satisfy respective functions, and are not formed in consideration of the vibration generated in the main body 2. In the main body 2, the recesses create a portion where rigidity becomes locally low. The portion of the main body 2 where rigidity is low is more susceptible to vibration than other portions. For this reason, vibration displacement tends to be large in the portion where rigidity is low.

Also, the plurality of counterbores are often not formed in line symmetry about the strings 5 as viewed in the stringing direction (the X axis direction). It is considered that the vibration of the string 5 is uniformly transmitted in the Y axis direction with the string 5 as the center, so that well-balanced vibrations are generated in the main body 2. It is therefore considered that when the plurality of counterbores are not formed in line symmetry about the strings 5 as viewed in the stringing direction (the X axis direction), the location where vibration displacement is large is likely to occur being biased to the side where there are more counterbores.

In the main body 2, more counterbores are formed in the half on the Y axis negative direction side from the strings 5 (hereinafter referred to as "main body lower side") than in the half on the Y axis positive direction side from the strings 5 (hereinafter referred to as "main body upper side"). For example, the electrical component counterbore 21 and the jack counterbore 25 are formed only on the main body lower side. It is therefore considered that the location where vibration displacement is large is likely to occur being biased to the main body lower side. As a result, the balance of the mode shape of the entire body (balance of vibration) deteriorates.

On the main body lower side of the main body 2 there is formed a cutaway part 26 that is a portion formed by cutting away a part near the neck counterbore 23, to which the neck 4 is attached. Formation of the cutaway part 26 makes it easy for the player touch the proximal end side of the strings 5 and makes it easy for the player to play. By forming the cutaway part 26 on the Y axis negative direction side of the neck counterbore 23 in the main body 2 as shown in FIG. 1 and FIG. 3, it becomes easy to play particularly high-pitched sound.

On the other hand, by forming the cutaway part 26, the portion that was not cut and hence remained is formed as a protruding first protrusion 27.

Strap pins 281, 282 are provided at two locations on the main body 2. The strap pins 281, 282 are used to fix both ends of a strap used to allow the player to play the electric guitar 10 while standing. As shown in FIG. 3, the first strap pin 281 is attached to the proximal end of the main body 2 in the X axis direction (the end in the direction opposite to the distal end in the X axis direction where the neck counterbore 23 is formed). The second strap pin 282 (strap pin) is attached to a second protrusion 29 (attachment part). The second protrusion 29 is formed on the opposite side to the first protrusion 27 across the neck 4.

Attachment positions of the strap pins 281, 282 are determined so that the electric guitar 10 can be stably held when the strap is attached to the first strap pin 281 and the second strap pin 282. By providing the second protrusion 29 in the main body 2, the second strap pin 282 can be arranged on the distal end side of the neck 4. The strap makes it easier to hold the electric guitar 10 stably.

As described above, the first protrusion 27 and the second protrusion 29 are protrusions formed in the main body 2 in order to satisfy respective functions, and are not formed in consideration of the vibration generated in the main body 2. As a result of the main body 2 having the protrusions, a portion where rigidity becomes locally low is created. The portion of the main body 2 where rigidity is low is more susceptible to vibration than other portions. For this reason, vibration displacement tends to be large in the portion where rigidity is low.

Also, the first protrusion 27 and the second protrusion 29 are often not formed in line symmetry about the strings 5 as viewed in the stringing direction (the X axis direction). When viewed in the stringing direction (the X axis direction), the second protrusion 29 protrudes more than the first protrusion 27. For this reason, the rigidity of the second protrusion 29 is likely to be lower than the rigidity of the first protrusion 27. Thus, the second protrusion 29 is more susceptible to vibration. It is therefore considered that the location where vibration displacement is large is likely to occur being biased toward the second protrusion 29, which protrudes more than the first protrusion 27. As a result, the balance of the mode shape of the entire body (balance of vibration) deteriorates.

The electrical component counterbore rigidity reinforcing member 31 is a reinforcing material provided in the electrical component counterbore 21 for reinforcing rigidity. The material of the electrical component counterbore rigidity reinforcing member 31 may be a metal material or a fiber reinforced plastic (FRP) material. As shown in FIG. 1, the inner side surface of the electrical component counterbore 21 has a first contact region 211 and a second contact region 212 which are positioned apart from each other. The second contact region 212 may be opposed to the first contact region 211. As shown in FIG. 1, the electrical component counterbore rigidity reinforcing member 31 is provided between both of the inner surfaces (211, 212) so as to be in contact with the first contact region 211 and the second contact region 212 and to reinforce the rigidity. That is to say, the electrical component counterbore rigidity reinforcing member 31 is provided between the first contact region 211 and the second contact region 212. Further, one end of the electrical component counterbore rigidity reinforcing member 31 is in contact with the first contact region 211, and the other end of the electrical component counterbore rigidity reinforcing member 31 is in contact with the second contact region 212. As a result, in the body 1, the rigidity of the portion where the electrical component counterbore 21 is formed is increased. The electrical component counterbore rigidity reinforcing member 31 may be provided between both of the inner surfaces (211, 212) so as to be in contact with the first contact region 211 and the second contact region 212 and to apply pressure thereto.

By providing the electrical component counterbore rigidity reinforcing member 31, the rigidity of the main body 2 reduced as a result of forming the electrical component counterbore 21 can be increased by means of the reinforcement.

By increasing the reduced rigidity of the main body 2 by the reinforcement, it is possible to reduce the large vibration displacement that occurred in the electrical component counterbore 21.

Further, by increasing the rigidity of the electrical component counterbore 21 formed on the main body lower side where more counterbores are formed, it is possible to improve the vibration balance in which the portion where the vibration displacement was large was biased to the main body lower side rather than the main body upper side.

As a result, the vibrations of the strings 5 are transmitted to the body 1 in a well-balanced manner, producing rich vibration in the body 1, and feedback of the vibration can be made to the strings 5 or the bridge 65.

It is preferable that the positions of the first contact region and the second contact region on the inner surface of the electrical component counterbore 21 are set, so that the arrangement direction of the first contact region 211 and the second contact region 212 is a direction orthogonal to the direction (an orthogonal direction) in which the distance between the two mutually opposing regions on the inner surface of the electrical component counterbore 21 is the longest. This is because the orthogonal direction is the direction in which the rigidity is most likely to be reduced in the main body 2. By providing the electrical component counterbore rigidity reinforcing member 31 in the orthogonal direction, the rigidity of the main body 2 reduced as a result of forming the electrical component counterbore 21 can be more suitably increased by means of the reinforcement. The arrangement direction of the first contact region and the second contact region may be a direction in which a straight line connecting the first contact region and the second contact region extends. The arrangement direction of the first contact region and the second contact region may also be a direction orthogonal to both of the first contact region and the second contact region.

Moreover, the electrical component counterbore rigidity reinforcing member 31 may be in contact with three or more regions of the inner surface of the electrical component counterbore 21. When the electrical component counterbore rigidity reinforcing member 31 comes in contact with more regions, the vicinity of the electrical component counterbore 21 is further reinforced. As a result, the rigidity of the main body 2 reduced as a result of forming the electrical component counterbore 21 can be more suitably increased.

The protrusion rigidity reinforcing member 32 is a reinforcing member that reinforces the rigidity of the second protrusion 29 attached to the back surface 2*b* of the main body 2. The material of the protrusion rigidity reinforcing member 32 may be a metal material or a fiber reinforced plastic (FRP) material. The protrusion rigidity reinforcing member 32 is a strip-like plate material having a first end part 321 and a second end part 322. It is preferable that the rigidity of the protrusion rigidity reinforcing member 32 be higher than that of wood. Here, the first end part 321 and the second end part 322 are both end parts in the longitudinal direction of the protrusion rigidity reinforcing member 32. The protrusion rigidity reinforcing member 32 is curved as viewed from the plate thickness direction of the protrusion rigidity reinforcing member 32. The first end part 321 is fixed to a connecting portion of the second protrusion 29 and another portion of the main body 2 (near the root portion). The other portion of the main body 2 may be a portion where the neck 4 is attached to the main body 2. The first end part 321 may be fixed to an edge portion of the connecting portion. The second end part 322 is arranged at another portion of the body 1. The other portion of the main body 2 may be a portion of the main body 2 other than the second protrusion 29. The other portion of the body 1 may be the main body upper side portion. The other portion of the body 1 may be an edge portion of the main body upper side. By providing the protrusion rigidity reinforcing member 32, the rigidity of the second protrusion 29 is increased.

Here, the connecting portion between the second protrusion 29 and the other portion of the main body 2 is a portion where the rigidity is locally reduced due to the formation of the second protrusion 29. Since the shape of the connecting portion is discontinuous, the rigidity is reduced. By fixing the first end part 321 to the connecting portion, the rigidity of the portion where the rigidity is locally reduced is increased.

By providing the protrusion rigidity reinforcing member 32 to thereby reinforce the main body 2, the rigidity of the main body 2 reduced as a result of forming the second protrusion 29 can be increased.

By increasing the reduced rigidity by the reinforcement, it is possible to reduce the large vibration displacement that occurred in the second protrusion 29.

Further, by increasing the rigidity of the second protrusion 29, it is possible to improve the vibration balance in which the portion where the vibration displacement was large was biased to the second protrusion 29 side rather than the first protrusion 27 side.

As a result, the vibrations of the strings 5 are transmitted to the body 1 in a well-balanced manner, producing rich vibration in the body 1, and feedback of the vibration can be made to the strings 5 or the bridge.

If the first end part 321 of the protrusion rigidity reinforcing member 32 is arranged at a position near the root portion of the second protrusion 29, the second end part 322 may be arranged at a portion of the main body 2 distanced from the vicinity of the second protrusion 29. If the first end part 321 and the second end part 322 are arranged as far away as possible from each other, the rigidity of the second protrusion 29 can be suitably increased.

For example, the first end part 321 and the second end part 322 may be arranged on mutually opposite sides across the center axis of the main body 2 extending in the direction orthogonal to the plate thickness direction of the main body 2 with sandwiching the centrals axis therebetween. By setting the arrangement of the first end part 321 and the second end part 322 as described above, the rigidity of the second protrusion 29 can be more suitably increased. The direction orthogonal to the plate thickness direction of the main body 2 is, for example, the X axis direction or the Y axis direction. The center axis of the main body 2 is, for example, a main body center axis CX in the X axis direction or a main body center axis CY in the Y axis direction. Here, the protrusion rigidity reinforcing member 32 may have an elongated shape rather than an arch shape.

The protrusion rigidity reinforcing member 32 also extends in a direction perpendicular to the stringing direction (the X axis direction), and thus has a function other than the function of reinforcing the rigidity of the second protrusion 29. Specifically, by providing the protrusion rigidity reinforcing member 32, when vibration of "bending" in the Y axis direction occurs in the body 1, the rigidity against the vibration of the "bending" can be increased.

By increasing the rigidity against "bending" in the Y axis direction, it is possible to suppress the bridge counterbore 24 and the neck counterbore 23, which are locations that particularly affect the vibration of the strings 5, from becoming nodes of the standing wave of the natural frequency in the vibration mode. As a result, the vibration of the string 5 is easily transmitted to the body 1, and the vibration characteristic of the body 1 does not adversely affect the vibration of the string.

On the electric guitar 10 configured as described above, the player generates vibrations on the strings 5 by playing the strings 5 near the electromagnetic pickup. Here, vibrations that oscillate upward and downward in the Z axis direction and the Y axis direction occur in the string 5. The electromagnetic pickup converts the vibration into an electric signal by means of electromagnetic induction. In the conversion to the electric signal, controls of the volume switches 62, the pickup selector 63 and so forth are received. The electrical signal thus converted is output from the cable inserted into the jack 66.

As described above, the body 1 of the electric guitar 10 of the present embodiment includes the electrical component counterbore rigidity reinforcing member 31. With this configuration, the rigidity of the body 1 reduced as a result of forming the electrical component counterbore 21 can be more suitably increased by means of reinforcement.

Furthermore, the body 1 includes the protrusion rigidity reinforcing member 32. With this configuration, the rigidity of the main body 2 reduced as a result of forming the second protrusion 29 can more be suitably increased by means of reinforcement.

By increasing the reduced rigidity of the main body 2 by the reinforcement, it is possible to reduce the large vibration displacement that occurred in the electrical component counterbore 21 and/or the second protrusion 29.

The body 1 includes the electrical component counterbore rigidity reinforcing member 31 and the protrusion rigidity reinforcing member 32. With this configuration, even in a case where the counterbores (recesses) and the protrusions are not formed in line symmetry about the strings 5 as viewed in the stringing direction (the X axis direction), it is possible to improve the balance of the mode shape (vibration balance) of the entire body 1.

As a result, the vibrations of the strings 5 are transmitted to the body 1 in a well-balanced manner, producing rich vibration in the body 1, and feedback of the vibration can be made to the strings 5 or the bridge.

Moreover, the protrusion rigidity reinforcing member 32 also extends in the direction perpendicular to the stringing direction (the X axis direction). This configuration can increase the rigidity against "bending" in the Y axis direction. As a result, it is possible to suppress the bridge counterbore 24 and the neck counterbore 23 from becoming nodes of the standing wave of the natural frequency in the vibration mode.

By means of these effects, the electric guitar 10 including the body 1 can improve the vibration characteristics of the strings 5 and thus improve the sound quality.

Modified Example

Although one embodiment of the present invention was explained in detail with reference to the drawings, a concrete configuration of the invention is not limited to this embodiment, and design changes and so forth without departing from the scope of the invention are included. Furthermore, it is possible to suitably combine and configure the constituents shown in the embodiment and a modified example.

The description has been made using the electric guitar 10 as an embodiment of the present invention. However, the embodiment of the present application is not limited to application to electric guitars. For example, the embodiment of the present invention may be applied to a musical instrument that includes a solid body, such as an electric bass guitar. Also, in such a case, the same effects as those described above can be exhibited. In the present application, the electric guitar may include an electric bass guitar.

The body 1 may include either one of the electrical component counterbore rigidity reinforcing member 31 and the protrusion rigidity reinforcing member 32 only. Also, a reinforcing member equivalent to the electrical component counterbore rigidity reinforcing member 31 may be provided for a counterbore other than the electrical component counterbore 21. Formation of such a counterbore can increase the reduced rigidity of the main body 2.

The shape of the main body 2 is not limited to the shape of the body 1 of the generic electric guitar 10 as shown in the above embodiment. The main body 2 may also be of a body shape such as a V-shaped body shape further having a protrusion. Even with such a body, the same effects as those of the above embodiment can be exhibited by providing the protrusion rigidity reinforcing member 32.

The main body 2 and the neck 4 may be integrally formed. Even with such a configuration, the same effects as those of the above embodiment can be exhibited by providing the body main body 2 with the electrical component counterbore rigidity reinforcing member 31 or the protrusion rigidity reinforcing member 32.

The inner surface of the counterbore need not be parallel to the plate thickness direction (the Z axis direction) of the main body 2 and may be formed oblique. In such a case, the electrical component counterbore rigidity reinforcing member 31 may be provided so as to reinforce the rigidity of the obliquely formed inner side surface.

In the above embodiment, the protrusion rigidity reinforcing member 32 is attached to the back surface 2*b* of the main body 2. However, the attachment position of the protrusion rigidity reinforcing member 32 is not limited to the example described above. For example, the protrusion rigidity reinforcing member 32 may be attached to the interior of the wood of the main body 2. For example, in a case where a plurality of pieces of wood are stacked to form the main body 2, in order to reinforce the rigidity of the second protrusion 29, the protrusion rigidity reinforcing member 32 having higher rigidity than the pieces of wood may be sandwiched therebetween. In such a case, since the protrusion rigidity reinforcing member 32 is not exposed to the outside, it is possible to prevent deterioration of the appearance design of the electric guitar due to the attachment of the protrusion rigidity reinforcing member 32.

The protrusion rigidity reinforcing member 32 may extend from the back surface 2*b* of the main body 2 to the side surface or the front surface 2*a*. Furthermore, the protrusion rigidity reinforcing member 32 may be provided so as to extend from the front surface 2*a* to the back surface 2*b* therealong and surround the root portion of the second protrusion 29. By providing the protrusion rigidity reinforcing member 32 in this manner, the rigidity of the second protrusion 29 can be more suitably increased.

As a member separate from the protrusion rigidity reinforcing member 32, there may be provided a flexural rigidity reinforcing member having a first edge part and a second edge part. The flexural rigidity reinforcing member is provided so that it extends in a direction substantially orthogonal to the stringing direction (the X axis direction), and the first edge part and the second edge part of the flexural rigidity reinforcing member are arranged lined up in the Y axis direction. When vibration of "bending" in the Y axis direction occurs in the body 1, the flexural rigidity reinforcing member can increase the rigidity against the vibration of the "bending". The material of the flexural rigidity reinforcing member may be a metal material or a fiber reinforced plastic (FRP) material.

Moreover, by increasing the rigidity against "bending" in the Y axis direction, it is possible to suppress the bridge counterbore 24 and the neck counterbore 23, which are locations that particularly affect the vibration of the strings 5, from becoming nodes of the standing wave of the natural frequency in the vibration mode. As a result, the vibration of the string 5 is easily transmitted to the body 1, and the vibration characteristic of the body 1 does not adversely affect the vibration of the string.

Next, the results of analyzing the balance of the "mode shape" generated in the body 1 of the electric guitar 10 by means of simulation will be described with reference to FIG. 4A to FIG. 6B.

1-1. Simulation Setting

Figure 4A:
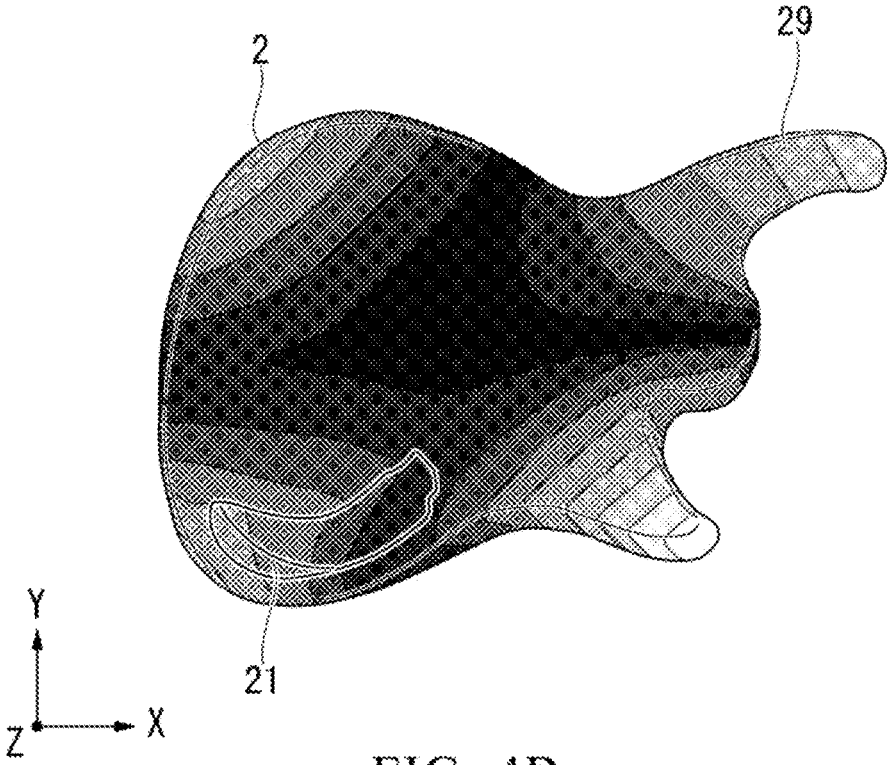
FIG. 4A is an analysis result of a mode shape in the body of FIG. 1 and FIG. 2.
Figure 4B:
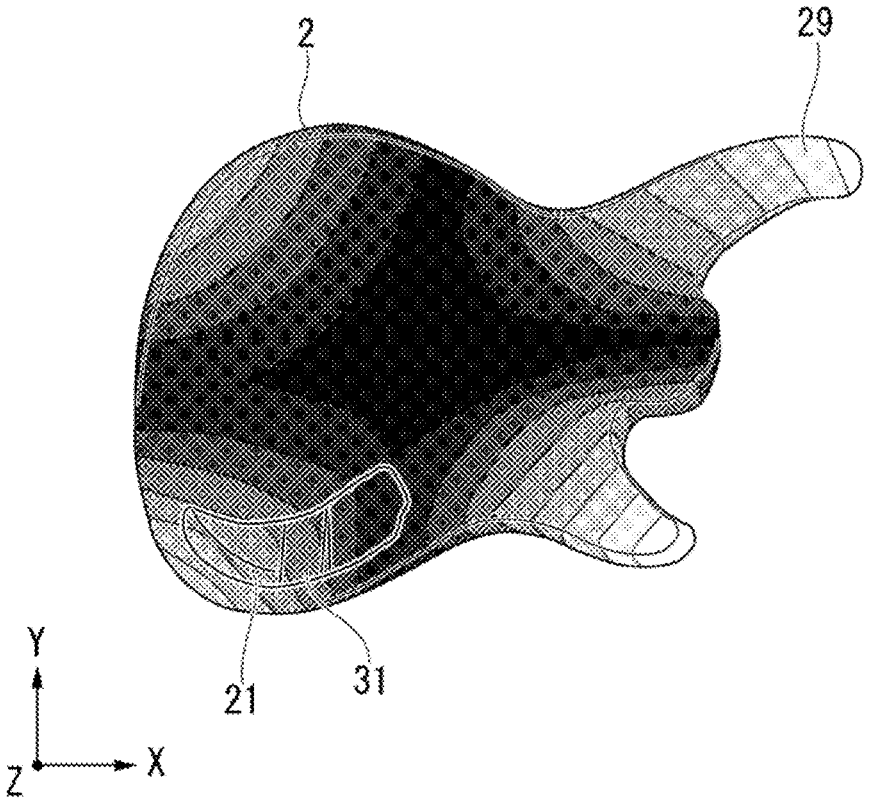
FIG. 4B is an analysis result of a mode shape in the body of FIG. 1 and FIG. 2.

The change in the balance of the mode shape due to the presence or absence of the electrical component counterbore rigidity reinforcing member 31 on the main body 2 is analyzed by means of the simulation, and the results are shown in FIG. 4A and FIG. 4B. Here, the protrusion rigidity reinforcing member 32 is not attached to the main body 2.

1-2. Simulation Results

The results of analysis by the simulation are shown in FIG. 4A and FIG. 4B. FIG. 4A and FIG. 4B show mode shapes in which "twist" is generated, among the mode shapes generated in the main body 2. In FIG. 4A and FIG. 4B, in the gray scale, the whiter portions represent larger vibration displacement and darker portions represent smaller vibration displacement.

FIG. 4A shows a mode shape in the case where the electrical component counterbore rigidity reinforcing member 31 is not attached to the main body 2. FIG. 4B shows a mode shape in the case where the electrical component counterbore rigidity reinforcing member 31 is attached to the main body 2.

As shown in FIG. 4A, in the case where the electrical component counterbore rigidity reinforcing member 31 is not attached to the main body 2, vibration displacement is large in the portion of the main body 2 where the electrical component counterbore 21 is formed.

As shown in FIG. 4B, in the case where the electrical component counterbore rigidity reinforcing member 31 is attached to the main body 2, vibration displacement is small in the portion of the main body 2 where the electrical component counterbore 21 is formed. The large vibration displacement that occurred in the portion where the electrical component counterbore 21 is formed is reduced.

Furthermore, the balance of the mode shape of the main body 2 (balance of vibration) is improved. The mode shape in FIG. 4B is closer to a shape line symmetric about the string 5 as viewed in the stringing direction (the X axis direction), as compared to the mode shape in FIG. 4A.

Moreover, by attaching the electrical component counterbore rigidity reinforcing member 31, the distal end part of the second protrusion 29 now vibrates much more. It is considered that the vibration is now uniformly transmitted to the main body 2 as a result of attaching the electrical component counterbore rigidity reinforcing member 31.

2-1. Simulation Setting

Next, the change in the balance of the mode shape due to the presence or absence of the protrusion rigidity reinforcing member 32 on the main body 2 is analyzed by means of the simulation, and the results are shown in FIG. 5A to FIG. 6B. Here, the electrical component counterbore rigidity reinforcing member 31 is not attached to the main body 2.

2-2. Simulation Results

Figure 5A:
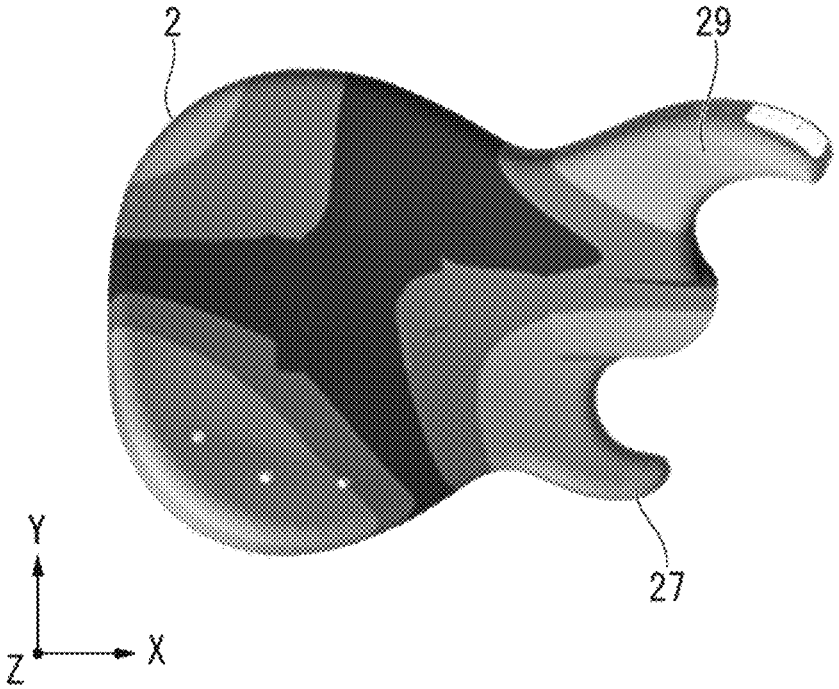
FIG. 5A is an analysis result of a mode shape in the body of FIG. 1 and FIG. 2.
Figure 5B:
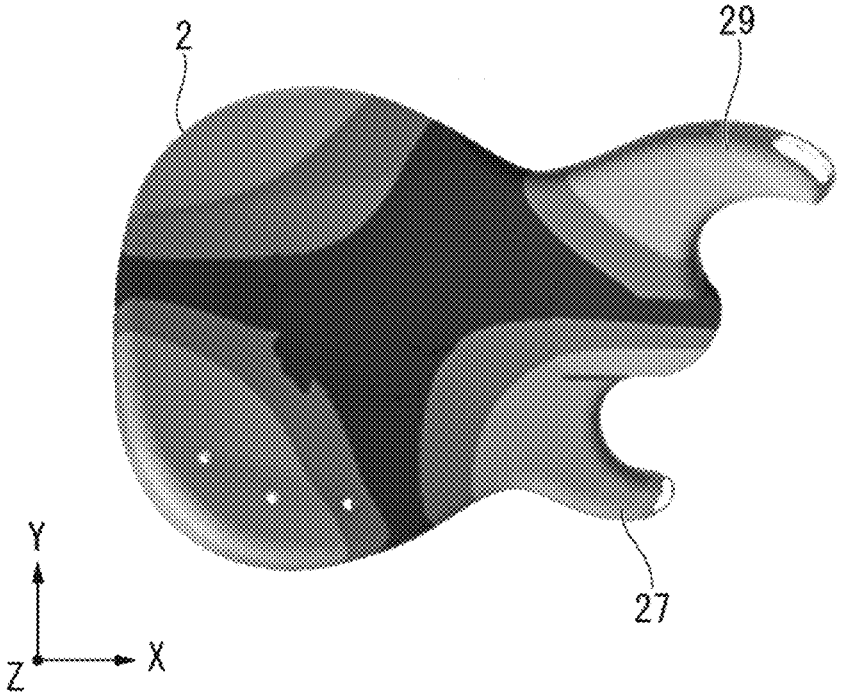
FIG. 5B is an analysis result of a mode shape in the body of FIG. 1 and FIG. 2.

The results of analysis by the simulation are shown in FIG. 5A and FIG. 5B. FIG. 5A and FIG. 5B show mode shapes in which "twist" is generated, among the mode shapes generated in the front surface 2*a* of the main body 2.

FIG. 5A shows a mode shape in the case where the protrusion rigidity reinforcing member 32 is not attached to the main body 2. FIG. 5B shows a mode shape in the case where the protrusion rigidity reinforcing member 32 is attached to the main body 2.

As shown in FIG. 5A, in the case where the protrusion rigidity reinforcing member 32 is not attached to the main body 2, vibration displacement is large in the distal end part of the second protrusion 29 as compared to the distal end part of the first protrusion 27. The distal end part of the second protrusion 29 protrudes more than the distal end part of the first protrusion 27.

As shown in FIG. 5B, in the case where the protrusion rigidity reinforcing member 32 is attached to the main body 2, vibration displacement is small in the distal end part of the second protrusion 29. Further, the vibration displacement in the distal end part of the first protrusion 27 is large. The large vibration displacement that occurred in the second protrusion 29 is now reduced.

Furthermore, the balance of the mode shape of the main body 2 (balance of vibration) is improved. The mode shape in FIG. 5B is closer to a shape line symmetric about the string 5 as viewed in the stringing direction (the X axis direction), as compared to the mode shape in FIG. 5A. It is considered that the vibration is now uniformly transmitted to the main body 2.

2-3. Simulation Results

Figure 6A:
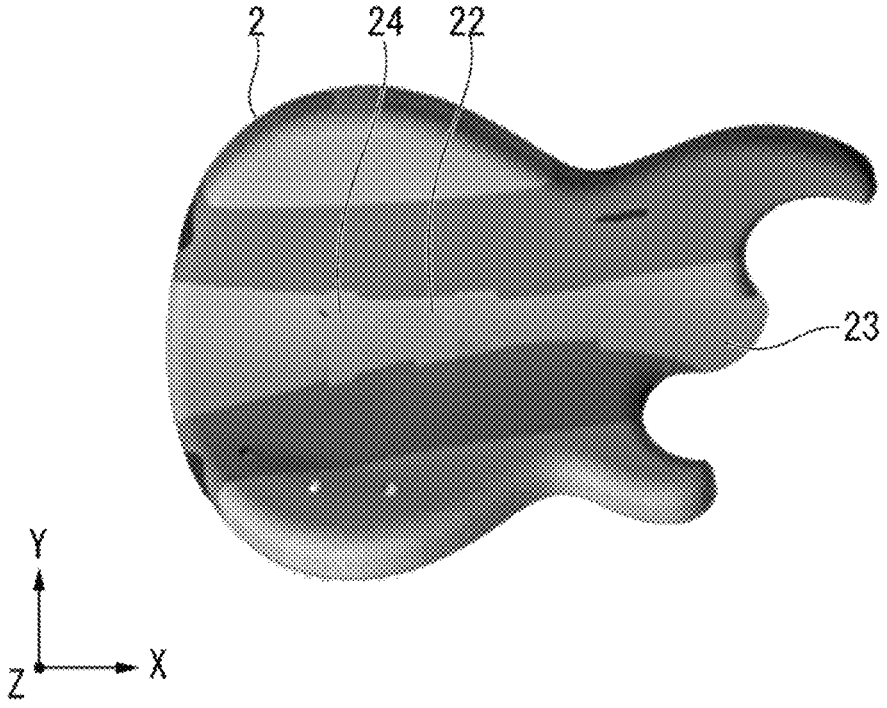
FIG. 6A is an analysis result of a mode shape in the body of FIG. 1 and FIG. 2.
Figure 6B:
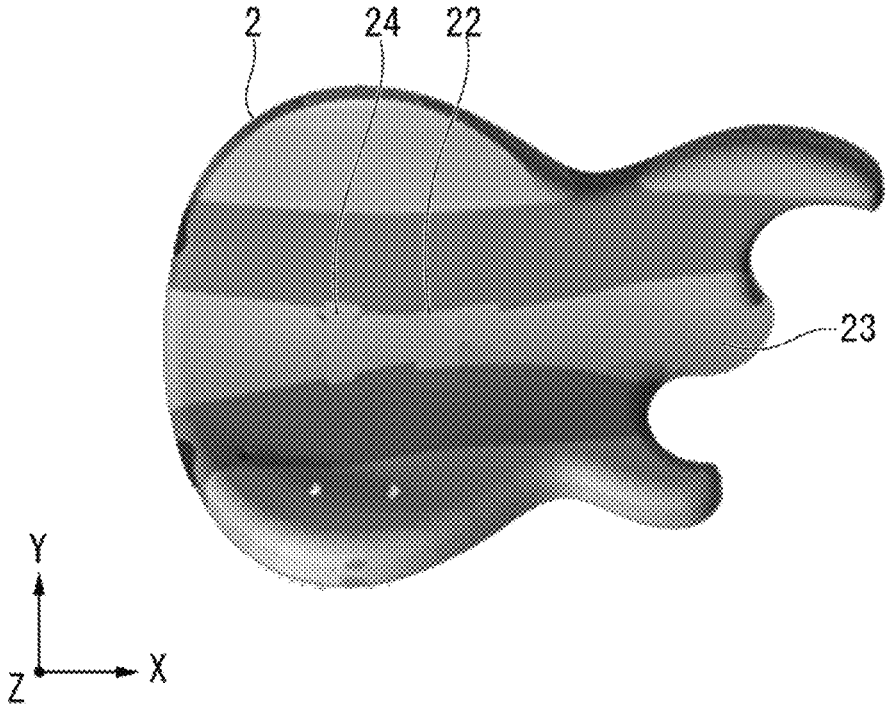
FIG. 6B is an analysis result of a mode shape in the body of FIG. 1 and FIG. 2.

FIG. 6A and FIG. 6B show mode shapes in which "bending" is generated in the Y axis direction, among the mode shapes generated in the front surface 2*a* of the main body 2.

FIG. 6A shows a mode shape in the case where the protrusion rigidity reinforcing member 32 is not attached to the main body 2. FIG. 6B shows a mode shape in the case where the protrusion rigidity reinforcing member 32 is attached to the main body 2.

Comparing the mode shape of FIG. 6B to the mode shape of FIG. 6A, the balance of the mode shape of the main body 2 (balance of vibration) is improved. The mode shape in FIG. 6B is closer to a shape line symmetric about the string 5 as viewed in the stringing direction (the X axis direction), as compared to the mode shape in FIG. 6A. It is considered that the vibration is now uniformly transmitted to the main body 2.

In FIG. 6A and FIG. 6B, two strip-like bands in dark gray extending in the Y axis direction correspond to nodes of standing waves of the natural frequency in this vibration mode.

As shown to FIG. 6A, in the case where the protrusion rigidity reinforcing member 32 is not attached to the main body 2, the portions corresponding to the nodes of standing waves overlap with part of the electromagnetic pickup counterbore 22, the neck counterbore 23, and the bridge counterbore 24.

As shown in FIG. 6B, in the case where the protrusion rigidity reinforcing member 32 is attached to the main body 2, the areas of the overlapping portions are smaller.

It is considered that by providing the protrusion rigidity reinforcing member 32 so as to extend also in the direction perpendicular to the stringing direction (the X axis direction), the regions of the neck counterbore 23 and the bridge counterbore 24 that overlap with the portions corresponding to the nodes of standing waves of the natural frequency in the vibration mode are reduced.

According to an embodiment of the present invention, it is possible, in the body of an electric guitar, to improve sound quality by adjusting the balance of generated mode shape (vibration balance).

The present invention may be applied to a body of an electric guitar and to an electric guitar.

What is claimed is:

1. A body of an electric guitar comprising:

a main body that comprises a solid body and comprises a protrusion; and a protrusion rigidity reinforcing member that is attached to the main body, wherein at least a part of the protrusion rigidity reinforcing member is fixed to a connecting portion between the protrusion and another portion of the main body, the protrusion rigidity reinforcing member comprises a first end part and a second end part, and the first end part and the second end part are disposed on opposite sides of a central axis of the main body with sandwiching the central axis therebetween, the central axis extending in a direction orthogonal to a thickness direction of the main body.

2. The body of an electric guitar comprising: according to claim 1, wherein the main body further comprises a recess, and the body of the electric guitar further comprises:

a recess rigidity reinforcing member that is in contact with two or more contact regions of an inner surface of the recess and reinforces the rigidity of the recess, the two or more contact regions being located away from each other.

3. The body of an electric guitar according to claim 2, wherein the two contact regions are arranged in a direction orthogonal to a direction in which two regions of the inner surface of the recess are arranged, the two regions facing each other and having a most distance therebetween.

4. The body of an electric guitar according to claim 2, wherein the recess is an electrical component counterbore that stores an electrical component of an electric guitar.

5. The body of the electric guitar according to claim 1, wherein the protrusion is an attachment part to which a strap pin is attached.

6. The body of an electric guitar according to claim 1, further comprising:

a flexural rigidity reinforcing member that comprises a first end part and a second end part and is attached to the main body, wherein the first end part of the flexural rigidity reinforcing member and the second end part of the flexural rigidity reinforcing member are arranged in a direction orthogonal to a stringing direction in which a string of an electric guitar are to be strung.

7. An electric guitar comprising the body according to claim 1.

* * * * *